US006233941B1

(12) United States Patent
Youssef

(10) Patent No.: US 6,233,941 B1
(45) Date of Patent: May 22, 2001

(54) CONDENSATION SYSTEM

(75) Inventor: Mustafa Youssef, Zürich (CH)

(73) Assignee: Asea Brown Boveri AG, Baden (CH)

( * ) Notice: Subject to any disclaimer, the term of this patent is extended or adjusted under 35 U.S.C. 154(b) by 0 days.

(21) Appl. No.: 09/255,711

(22) Filed: Feb. 23, 1999

(30) Foreign Application Priority Data

Feb. 25, 1998 (EP) ..... 98810150

(51) Int. Cl.[7] ..... F01K 1/00; F01K 19/10

(52) U.S. Cl. ..... 60/670; 60/688; 60/692; 60/693

(58) Field of Search ..... 60/670, 688, 692, 60/693

(56) References Cited

U.S. PATENT DOCUMENTS

| | | | | |
|---|---|---|---|---|
| 3,820,334 | | 6/1974 | Heller et al. . | |
| 3,834,133 | | 9/1974 | Bow . | |
| 4,788,824 | * | 12/1988 | Spurr et al. | 60/670 X |
| 5,133,190 | * | 7/1992 | Abdelmalek | 60/670 X |
| 5,551,238 | * | 9/1996 | Prueitt | 60/670 X |

FOREIGN PATENT DOCUMENTS

| | | |
|---|---|---|
| 402909 | 11/1965 | (CH) . |
| 543372 | 2/1932 | (DE) . |
| 2204723 | 8/1972 | (DE) . |
| 2452123 | 5/1976 | (DE) . |
| 0 461 515 | 12/1991 | (EP) . |

OTHER PUBLICATIONS

"Cutting the Fog", R. Clark, Chemical Engineer Oct. 29, 1992, pp. 22–23.

"Betriebserfahrungen und weitere Entwicklungsergebnisse mit dem Helle bei Luftkondensation fur Kraftwerksanlagen", Heller et al., Energietechnik, Dec. 1963, pp. 552–557.

* cited by examiner

*Primary Examiner*—Hoang Nguyen
(74) *Attorney, Agent, or Firm*—Burns, Doane, Swecker & Mathis, L.L.P.

(57) ABSTRACT

A condensation system for the condensation of turbine exhaust steam has a condenser installation (25) in which a surface condenser (30) and a direct-contact condenser (35) work in combination. In this case, the two condensers (30, 35) are either arranged in a single common housing or are each arranged in a separate housing. In one embodiment, the condenser installation (25) is connected in a circulation circuit for the cooling media to a wet-dry cooling tower or hybrid cooling tower (40). In this case, the cooling water of the surface condenser (30) is recooled in the wet part (42) and the cooling condensate of the direct-contact condenser (35) is recooled in the dry part (41) of the hybrid cooling tower (40). The condensation system according to the invention has the advantages that the manufacturing costs of the condenser installation are reduced by reducing the tube heating surface, the power of the turbine is increased by reducing the condenser pressure, no fog is caused by the hybrid cooling tower (40), and a smaller quantity of make-up cooling water is required.

6 Claims, 3 Drawing Sheets

CONDENSATION SYSTEM

FIELD OF THE INVENTION

The invention relates to a system for the condensation of turbine exhaust steam, having a condenser installation and a cooling installation, two different condensation principles being combined in the condenser installation, and two types of cooling, circulation cooling or circulation/once-through cooling, being connected in the cooling installation to the condenser installation.

BACKGROUND OF THE INVENTION

Various types of condenser installations are known, such as, for example, water-cooled surface condensers and direct-contact or jet condensers. Water-cooled surface condensers are distinguished by a multiplicity of cooling tubes, through which cooling water flows and into which the water is directed via large water chambers and on which exhaust steam flowing in from a turbine is precipitated. In this type of condenser, however, the manufacture of the cooling tubes and water chambers is expensive. Surface condensers are nowadays realized with once-through cooling or with circulation cooling, for example with a wet or dry cooling tower. In once-through cooling systems, water from a natural body of water is used open circuit as cooling medium for condensers. This type of cooling is used at sites where such fresh water is available in sufficiently large quantities at acceptable costs. In this case, the effects on the environment, such as, for example, the heating of river water, are also to be taken into account. Once-through cooling can also only be used for those condensers, such as, for example, surface condensers, in which the cooling medium does not come in direct contact with the turbine steam.

If fresh water is not available in sufficient quantity or is not a suitable cooling medium for reasons of environmental protection, various circulation circuits with recooling of the cooling medium are used. In a circulation circuit, the cooling medium flows through the condenser installation, in which it heats up due to the condensation of turbine exhaust steam and is then fed to a cooling tower for recooling and is finally pumped back to the condenser. Cooling towers are classified as wet cooling towers and dry cooling towers, the cooling medium being cooled in the former in an open system accessible to the air and in the latter in a closed system inaccessible to the air. Wet cooling towers are efficient due to the favorable heat transfer between water and air; the heat transferred leads to an evaporation of about 1 to 2% of the water flow. However, they have the known disadvantage that, due to the evaporation, they cause fog, sleet and shadows, which increasingly are becoming less acceptable in residential and farming regions. Furthermore, the evaporated water has to be replaced by fresh water. Dry cooling towers have the advantage of not causing such fog, but are less efficient compared with wet cooling towers and require an additional and complicated cooling area in the cooling tower.

Further cooling towers realized nowadays are the wet-dry cooling towers, also known as hybrid cooling towers, as described, for example, in DE 24 52 123 and in "Cutting the fog", The Chemical Engineer, Oct. 29, 1992. These cooling towers meet in particular the demands for environmental protection and the reduction in the water loss in order to avoid fog, sleet and shadows caused by the fog. To this end, the cooling water of a surface condenser is cooled in two circulations, having a dry cooling-tower part and a wet cooling-tower part. During dry cooling, the cooling water is passed through ribbed heat-exchange tubes, as a result of which the air of the dry cooling-tower part heats up by convective heat transfer. During the wet cooling, the air heats up in direct contact between air and water. Due to evaporation of the water, the air humidity increases and air saturated with water results. This saturated air mixes with the warm dry air of the dry cooling-tower part, so that a moist air flow is obtained and fog no longer develops. In order to reduce the humidity of the wet air to a practical value, approximately 20% of the heat must be given off during the dry cooling. In the hybrid cooling towers, the advantages of both cooling methods can be combined, namely the high cooling capacity of the wet method and the freedom from fog due to the dry method. In this case, the degree of hybridization, depending on the weather, can be varied by a bypass of the cooling water between dry part and wet part in order to optimize the final humidity of the air mixture.

A condensation system, also called the Heller system, is described, for example, in L. Heller and L. Forgo, "Betriebserfahrungen und weitere Entwicklungs-ergebnisse mit dem Heller-System bei Luftkondensation für Kraftwerke", Energietechnik Dec. 13, 1963 or *Grosse Kraftwerke,* third volume, Springer Verlag 1968. Here, the turbine exhaust steam is condensed in a direct-contact condenser by suitable condensate, of which some of the condensate is fed to the water/steam cycle and the remainder is fed to a cooling circulation with a dry cooling tower. One of the advantages of a direct-contact condenser over a surface condenser is its very low or even zero temperature-difference rating, as a result of which the condenser pressure is reduced and the turbine power is increased. Furthermore, this type of condenser is more convenient to manufacture, since the expensive tubing in the condenser and the water chambers are omitted. Finally, no water losses occur in the dry cooling tower. However, the system has the disadvantage that a complicated heating surface is required in the dry cooling tower. In particular, this surface is larger compared with a system of the same capacity with surface condenser and wet cooling tower, since the heat transfer to the air is poorer.

SUMMARY OF THE INVENTION

Accordingly, one object of the invention is to provide a novel condensation system which, while retaining the advantages of the systems referred to, is cost-effective in its manufacture and at the same time achieves a power gain of the turbine due to a reduction in the condenser pressure. This object is achieved by a condensation system invention preamble of claim 1, which condensation system has a surface condenser and a direct-contact condenser in its condenser installation, the two condensers working in combination, and the condenser cooling media passing through separate cooling circuits in the cooling installation.

In a first embodiment, the two condensers of the installation are accommodated in a single, common housing, in which both types of condensation take place, one on the surface of cooling tubes and the other on separate sprayed condensate. In a second embodiment, the two condensers are each arranged in a separate, self-contained housing. In this case, the steam is passed via a common turbine exhaust-steam nozzle to the housings of the surface condenser and the direct-contact condenser.

The condenser installation is connected in two separate circulation circuits via circulation lines to a wet-dry or hybrid cooling tower, the cooling water of the surface condenser being recooled in the wet part by evaporation, and the condensate of the direct-contact condenser being recooled in the dry part of the hybrid cooling tower by convection.

The main advantage of this condensation system lies in the use of a direct-contact condenser as part of the condenser installation together with a surface condenser instead of a single surface condenser. In this system, the opportunity is taken to build a direct-contact condenser for the dry part of a hybrid cooling tower, in which the cooling medium is inaccessible to the air. This results in a saving in material and fabrication expense. The total costs of a surface condenser are mostly determined by the costs of the tubing, supporting plates for the tubes and water chambers. By the use of a direct-contact-condenser part in the installation according to the invention, the tube heating surface, supporting plates and water chambers can be reduced, for example, by up to 50%, as a result of which an estimated 35% of the total costs of the condenser installation can be saved. The total costs of the installation can be reduced even further by the volume of the direct-contact condenser being reduced while the capacity stays the same. This is possible if, in the direct-contact condenser, the condensate is not sprayed as droplets but is distributed as a very thin and turbulent water film. The heat transfer to a film of this type reaches a multiple of the heat transfer to droplets, so that the same capacity can be achieved in a smaller volume. Finally, the use of a direct-contact condenser results in the advantage that the temperature-difference rating of the direct-contact-condenser part reaches the zero value. The reduction in the temperature-difference rating at the same time brings about a reduction in the condenser pressure, as a result of which a power gain of the turbine is achieved. The advantages of a hybrid cooling tower with regard to the environment, such as, for example, the avoidance of fog, are retained in the condensation system according to the invention. The requirement for less fresh make-up water compared with entirely wet cooling towers is also retained, since only some of the cooling water of the entire condenser installation is cooled by the wet process.

A bypass between the wet cooling cycle and the dry cooling cycle for regulating the air humidity at the cooling tower outlet is not possible in this system. However, such regulating is not necessary, since the heat flow of the dry cooling may be up to 50% and the moisture in the emerging air mixture is kept well away from the saturated region during all operating loads and seasons.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE INVENTION

Figure 1:
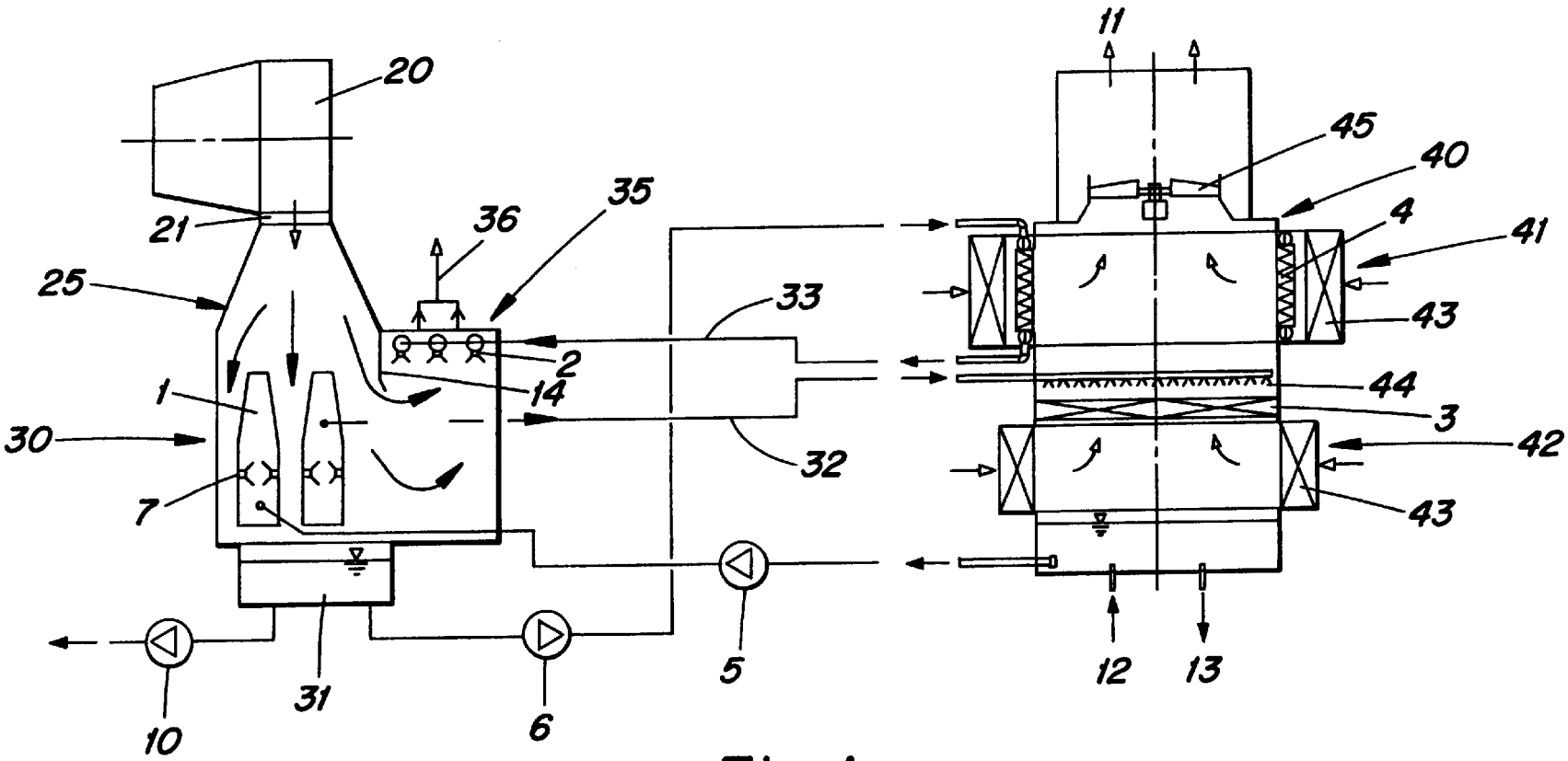
FIG. 1 shows a condensation system having a condenser installation with two combined condenser types in a single housing and connected to a hybrid cooling installation.

Referring now to the drawings, wherein like reference numerals designate identical or corresponding parts throughout the several views, in FIG. 1 a system for the condensation of the exhaust steam of a low-pressure turbine 20 is shown. The latter has a condenser installation 25, in which two condensers, a surface condenser 30 combined with a direct-contact condenser 35, are arranged in a common housing having a common condensate-collecting vessel (hot well) 31. The steam from the low-pressure turbine 20 flows via an exhaust-steam nozzle 21 into the housing of the condenser installation 25. It condenses there in the surface condenser 30 on cooling tubes, which are combined in tube bundles 1, and in the direct-contact condenser 35 on sprayed condensate.

According to the arrow directions, a portion of the steam flows around into the flow lanes and into the tube bundles 1, and a further portion flows around a flow guide baffle 14 into the direct-contact-condenser part 35. The baffle 14 ensures that the steam in the region of the spray nozzles 2 of the direct-contact condenser 35 flows up from below in counter/crossflow to the spray drizzle of the condensate. By the deflection of the steam flow, on the one hand a counterflow to the condensate flow is produced in the ideal case, but on the other hand a pressure loss is also caused, and this pressure loss is to be minimized. In order to optimize the flow conditions in the direct-contact condenser while simultaneously minimizing the pressure loss, the flow is directed, for example, by means of one or more sloping or curved baffles.

The function of these baffles 14 is in particular to optimize the deaeration of the condensate in the direct-contact condenser. On account of the counterflow, the condensate which is falling down always loses oxygen and other gases while it is raining down. In the process, a situation must be avoided in which steam in the direct-contact condenser having a higher oxygen content comes in contact with the hot well, since otherwise the oxygen passes into the hot well and the oxygen content in the condensate increases. To this end, the baffles 14 are arranged in such a way that the new exhaust steam flowing in from the turbine and having a low oxygen content is passed directly down to the hot well 31, and a cushion of new exhaust steam which has not yet come in contact with the condensate forms over the condensate surface in the hot well 31. The steam having a lower oxygen content flows over the hot well 31 and upward. Furthermore, in order to minimize contact between the hot well and the steam having a higher oxygen content in the direct-contact condenser, the hot well 31 extends, for example, only over the bottom of the surface condenser and not over the bottom of the direct-contact-condenser part. Furthermore, the baffles 14 ensure that the live-steam flow runs in counterflow to the condensate flow from as far down below as possible.

The use of flow baffles for the purpose of forming a steam cushion above the hot well and effecting a counterflow to the condensate flow in the direct-contact condenser is also feasible in condensers having horizontal exhaust-steam flow from the turbine. The position of the hot well below the surface condenser and/or direct-contact condenser is optimized in this case. Due to part of the surface condenser being replaced by a direct-contact condenser, the housing is no longer supported by the supporting plates of the tube bundles. Measures for supporting the housing of the combined condenser installation are, for example, tubes, anchors or baffles between supporting plates and condenser wall.

The combined condenser installation 25 is connected via circulation lines 32, 33 to a hybrid cooling tower 40, in which the cooling media of the condenser installation are recooled. The cooling water for the surface condenser 30 passes into the tubes of the tube bundles 1 via water chambers (not shown). After flowing through the cooling tubes, it is directed via a circulation line 32 by means of a circulation pump 5 to the wet part 42 of the hybrid cooling tower 40, where it is sprayed from spray nozzles 44 over a fill or fill material 3. Cool air flows according to the arrow direction through air filters 43 and fill material 3, in the course of which the water cools down, flows into a collecting vessel and is pumped back to the surface condenser 30 via the pump 5.

The direct-contact condenser 35 has a plurality of spray nozzles 2 or spray valves, which spray cooled condensate of virtually feedwater quality into the steam space. The steam from the turbine condenses here in direct contact with the cool condensate, in which case a temperature-difference rating of about zero can be achieved during this process. The sprayed condensate falls together with the newly formed condensate into the collecting vessel 31. Leading away from the latter are two lines, one to a feedwater pump 10, which returns a proportion of the condensate in accordance with the exhaust-steam flow into the water/steam cycle, the other to a circulation pump 6, which directs the remaining, large condensate flow into a closed cooling circuit not accessible to the air. The condensate is directed by the circulation pump 6 via the circulation line 33 through ribbed heat-exchanger tubes 4, where it gives off convective heat to the air, which according to the arrow direction flows through air filters 43 and by the action of fans 45 or by natural air draft upward past the tubes and mixes with the wet air from the wet cooling. After flowing through the heat-exchanger tubes 4, the condensate passes via the circulation line 33 back into the direct-contact condenser 35.

Water losses due to evaporation occur in a cooling circulation through a wet cooling tower. About 1 to 2% of the flow to be cooled is lost. The salt content of the water increases due to the replacement of these water quantities. By the addition of larger quantities of fresh make-up water and the drawing-off of salt water, the evaporated water is replaced on the one hand, and the salt content in the cooling circuit is stabilized on the other hand. To this end, two water lines 12', 13 are arranged on the hybrid cooling tower 40, the one serving to supply fresh water and the other serving to draw off the salty water. A quantity of fresh make-up water is added per circulation of cooling water of the surface condenser, this quantity corresponding to about 5% of the cooling-water quantity of the open circulation. In comparison, the requisite quantity of make-up water of a condensation installation with only a surface condenser and recooling by a wet cooling tower is up to 5% of the total quantity. In the system according to the invention, this quantity of make-up water is reduced by up to half in accordance with the apportioning of the condensation between surface condenser and direct-contact condenser, since some of the condensation capacity is taken over by the direct-contact condenser and its cooling condensate flows in a closed, virtually loss-free circulation.

Figure 2:
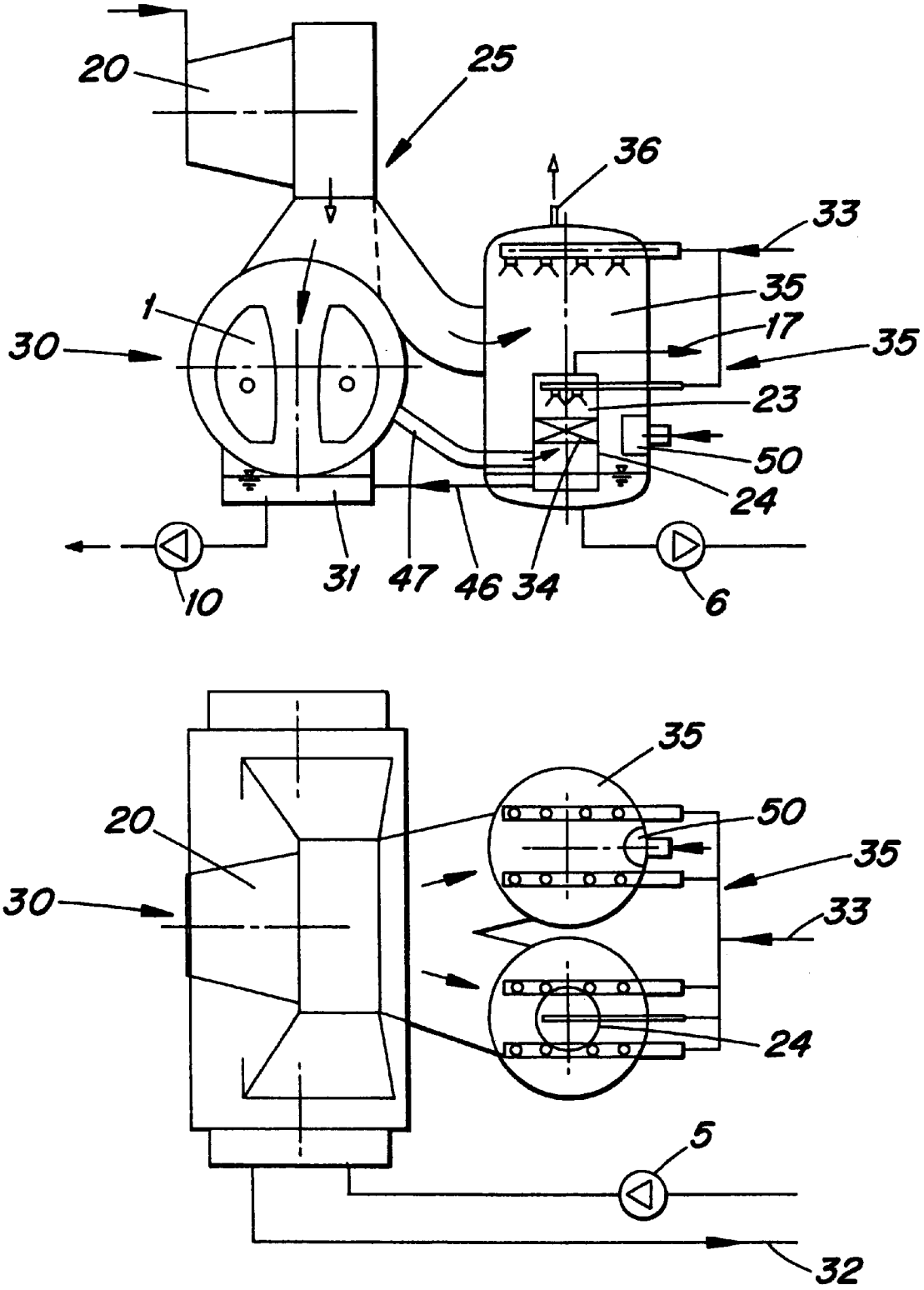
FIG. 2 shows a side view and a plan view of a condensation system having a surface condenser and a direct-contact condenser arranged in separate housings.

In a further embodiment of the invention according to FIG. 2, the condensation system is designed in the same way as in FIG. 1 but with the difference that the surface-condenser part and the direct-contact condenser part are separated by virtue of the fact that each is accommodated in a self-contained housing. FIG. 2 shows this embodiment using the example of a cylindrical surface condenser 30 and a direct-contact condenser 35 which are connected to the turbine 20 via an exhaust-steam nozzle. Instead of one direct-contact condenser, a plurality of direct-contact condensers, as shown in the plan view, may also be arranged. Only two possible embodiments of the combination of a surface condenser and a direct-contact condenser are shown in the figures. Further conceivable arrangements are, for example:

a) In the so-called platform mounting, the condenser installation is arranged under the turbine and the steam flow runs vertically from the turbine as in FIG. 1, and
   the direct-contact condenser is split into two parts, which are arranged on either side of the surface condenser, or
   the direct-contact condenser is arranged behind the surface condenser instead of next to the latter.
b) In the so-called floor mounting, the turbine and the condenser installation are arranged at ground level and the steam flow runs horizontally and laterally away from the turbine or in the direction of the turbine axis, and
   the direct-contact condenser is arranged next to the surface condenser, or
   behind the surface condenser.

In one variant, the direct-contact-condenser part of the combined condenser installation according to the invention is connected to a dry cooling tower, and the surface-condenser part is connected to a once-through cooling system with cooling water from a natural body of water.

In a further variant, the surface-condenser part is connected to a separate wet cooling tower, and the direct-contact-condenser part is connected to a separate dry cooling tower. The exhaust air of the two cooling towers is united and mixed via lines, as a result of which the humidity is reduced and fog is avoided.

In order to obtain as low a pressure as possible in the condenser installation and to increase the power of the turbine, the condensate, as far as possible, is freed of noncondensable gases (air). In surface condensers this is realized, for example as shown in FIG. 1, by virtue of the fact that the steam/air mixture is collected in air coolers 7 in a minimum-pressure zone of each tube bundle 1 and is drawn off via suction pipes (not shown).

Figure 3:
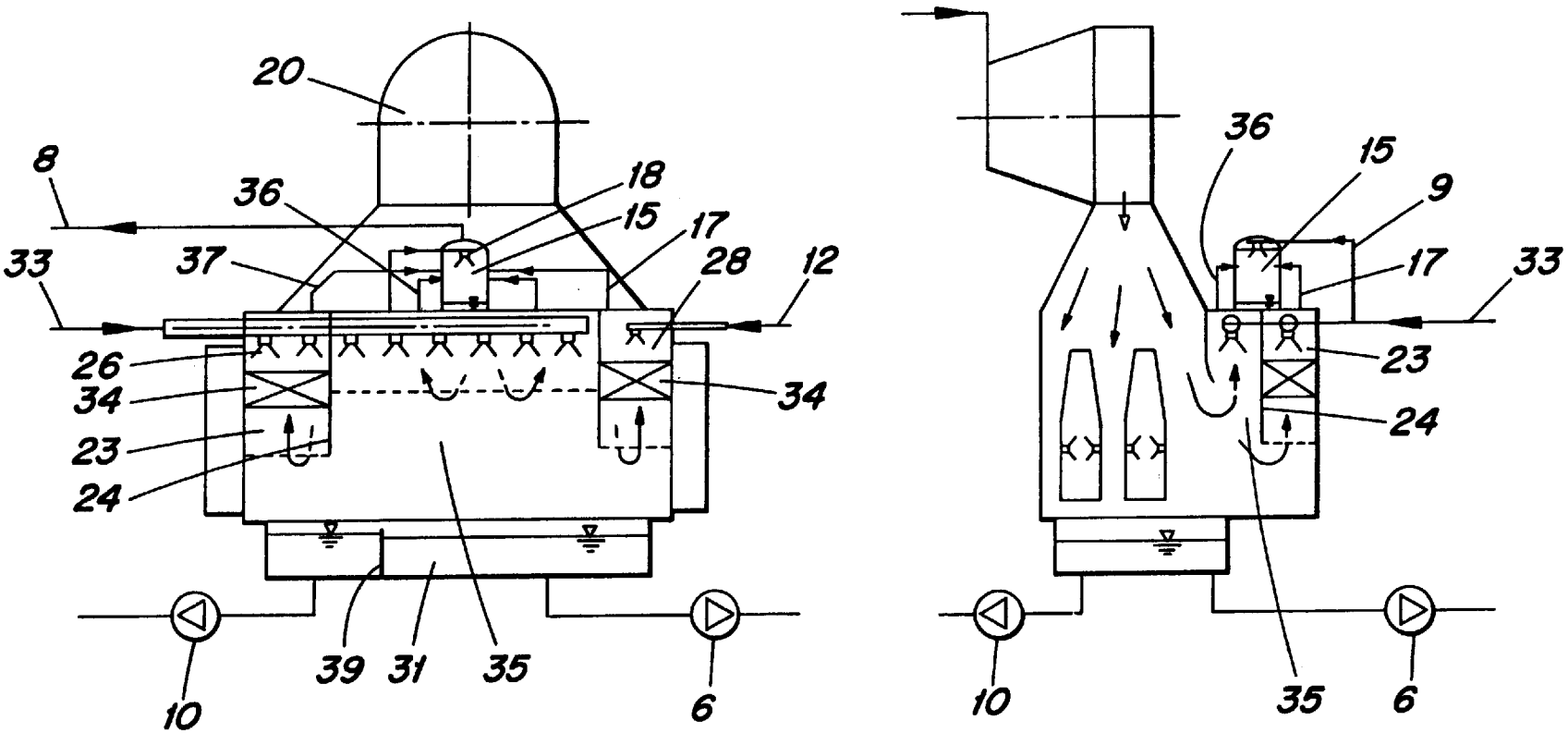
FIG. 3 shows an elevation and a side view of a combined condenser installation having a venting condenser and internal deaerators for cooling condensate and make-up water.

In the direct-contact-condenser part, noncondensable gases, according to FIG. 3, are removed from the condenser housing through a number of venting pipes 36, 37, 17 via a venting condenser 15. In the embodiment according to FIG. 3, the direct-contact condenser 35 is equipped with an internal deaerator 23. The latter is arranged in the direct-contact condenser 35 in a type of cabin, which is formed by plane dividing walls 24 and the housing wall of the direct-contact condenser 35, the rear dividing wall being indicated by a broken line. The dividing walls 24, which may also be of cylindrical design, extend downward from the top of the direct-contact-condenser space, but do not reach quite as far as the bottom of the space, so that steam can flow from below into the cabin. The deaerator 23 has spray nozzles 26, from which a partial flow of the cooling condensate is sprayed over a packing or built-in components 34. A further deaerator 28 for make-up water, which is added to the water/steam cycle in order to compensate for losses caused by the bleeding of process steam, is formed like the deaerator 23 by dividing walls in a type of cabin and has spray nozzles, which spray the cooling condensate over a packing or built-in components 34. In both deaerators 23, 28, the steam flows from below in counterflow to the condensate flow. In a variant, the steam flows down via an opening in the top region of the dividing walls 24 as well as up from below in parallel/counterflow to the condensate flow. In this case, the venting between the two parallel-flow and counterflow columns is arranged as disclosed by EP 0 461 515. The make-up water may also be directed into the deaerator 23, so that only one deaerator is built in the direct-contact-condenser space.

In the embodiment of the condenser installation 25 having separate condenser housings according to FIG. 2, the direct-contact condenser 35 likewise has an internal deaerator 23. The deaerator 23 and the packing 34 arranged therein are preferably of cylindrical design. The deaeration takes place in a similar manner as in FIG. 3. A steam line leads from the surface condenser 30 to the deaerator 23, as a result of which the steam flows in counterflow to the condensate flow. The condensate which accumulates is directed via a connecting line 46 from the deaerator 23 to the hot well 31 of the surface condenser 30. A make-up-water deaerator may be integrated, for example, in the second direct-contact-condenser space.

In FIG. 3, the steam/air mixture of the direct-contact condenser and its internal deaerators is fed to the venting condenser 15. The latter is built onto the direct-contact condenser 35, but may also be integrated inside the housing. The steam/air mixture flows via several different lines into the venting condenser 15: via the line 17 from the make-up-water deaerator 28, via the line 36 of the direct-contact condenser, and via the line 37 from the deaerator 23 of the direct-contact condenser. Most of the steam is precipated there on condensate which is sprayed from spray nozzles 18. In this case, the spray nozzles 18 are fed via a line 9 with bypass condensate from the circulation line of the dry cooling 33. The noncondensable gases are drawn off by a steam/gas mixture from the venting condenser 15 via a suction pipe 8. The level of the condensate in the venting condenser is held by a siphon, which leads from the venting condenser into the direct-contact condenser.

The resulting condensate from both condensers trickles down into a condensate-collecting vessel 31, from where it is fed partly to the cooling circulation via the circulation pump 6 and partly to the water/steam cycle (not shown) via the feedwater pump 10. The hot well 31 has a weir 39 for the purpose of separating the high-quality condensate coming from the surface condenser 30 and the deaerator 23 for the water/steam cycle and the condensate of lower quality coming from the direct-contact condenser and make-up-water deaerator. The level of the condensate for the water/steam cycle is controlled by a conventional control valve (not shown) downstream of the pump 10 and by a means of overflow into or from the condensate of the direct-contact condenser and make-up-water deaerator. There is a means for overflow between the condensate of the direct-contact condenser and that of the surface condenser with deaerator 23 and also openings in the top region of the weir 39, which let the condensate through.

As known, during the return of hot condensate in surface condensers, the condensate is first expanded in an expansion vessel or flashbox, in which the forming team rises upward while the condensate falls downward. In a direct-contact condenser there is more free space compared with a surface condenser. In a particular embodiment of the invention, the direct-contact condenser 35 in FIG. 2 has an internal flash-box 50 having a flat or arched deflecting plate. Steam flows along this plate, is distributed in the direct-contact condenser 35 and condenses on sprayed condensate, while condensate trickles down into the collecting vessel 31.

Obviously, numerous modifications and variations of the present invention are possible in light of the above teachings. It is therefore to be understood that, within the scope of the appended claims, the invention may be practiced otherwise than as specifically described herein.

What is claimed is:

1. A condensation system for the condensation of turbine exhaust steam, which is directed through one or more turbine exhaust-steam nozzles to a condenser installation, said condensation system comprising:

a condenser installation;

a cooling installation for condenser cooling media, the condenser installation having a surface condenser and a direct-contact condenser, both having respective condensing spaces;

said cooling installation further having two separate cooling-media circuits, wherein the cooling media of the surface condenser and the direct-contact condenser passes through the cooling-media circuits separately;

the surface condenser and the direct-contact condenser being arranged in a common condenser housing, or the surface condenser and the direct-contact condenser each being arranged in a separate condenser housing;

flow guide baffles being arranged in the condenser space of the direct-contact condenser, such that new exhaust steam flowing in directly from the turbine exhaust-steam nozzles is passed over a hot well and a cushion is formed above the hot well by said new exhaust steam and whereby a clear path is provided for a part of the new exhaust steam to flow from the turbine exhaust-steam nozzles to the hot well and on to the condensing space of the direct-contact condenser; and the steam flow runs counter or in crossflow to the condensate flow of the direct-contact condenser.

2. The condensation system as claimed in claim 1, wherein the direct-contact condenser has a venting condenser, which is built onto the direct-contact condenser or is integrated in the direct-contact-condenser space.

3. The condensation system as claimed in claim 1, wherein the direct-contact condenser has an internal deaerator having built-in components or a packing for deaerating condensate and increasing the water quality in the water/steam cycle, the steam flow running in counterflow or parallel/counterflow to the condensate.

4. The condensation system as claimed in claim 1, wherein the direct-contact condenser has an internal make-up-water deaerator having built-in components or a packing for deaerating make-up water for the water/steam cycle, the steam flow running in counterflow or parallel/counterflow to the condensate.

5. The condensation system as claimed in claim 1, wherein the direct-contact condenser has an internal expansion vessel having a deflecting plate.

6. The condensation system as claimed in claim 1, wherein the surface condenser of the condenser installation is connected in a once-through circuit to a natural body of water, and the direct-contact condenser is connected in a circulation circuit to a dry cooling tower.

* * * * *